United States Patent [19]

Fritts

[11] 4,149,057

[45] Apr. 10, 1979

[54] VARIABLE POWER CONTROL MICROWAVE OVEN

[75] Inventor: Rex E. Fritts, Cedar Rapids, Iowa

[73] Assignee: Amana Refrigeration, Inc., Amana, Iowa

[21] Appl. No.: 810,537

[22] Filed: Jun. 27, 1977

[51] Int. Cl.[2] ..... H05B 9/06

[52] U.S. Cl. ..... 219/10.55 B; 323/24

[58] Field of Search ..... 219/10.55 B, 10.55 C; 321/4; 323/8, 24, 34; 315/105

[56] References Cited

U.S. PATENT DOCUMENTS

| | | | |
|---|---|---|---|
| 3,862,390 | 1/1975 | Noda | 219/10.55 B |
| 3,973,165 | 8/1976 | Hester | 219/10.55 B X |
| 4,012,617 | 3/1977 | Burke et al. | 219/10.55 B |
| 4,023,004 | 5/1977 | Burke | 219/10.55 B |
| 4,041,267 | 8/1977 | Wechsler | 219/10.55 B |

*Primary Examiner*—Arthur T. Grimley

*Attorney, Agent, or Firm*—M. D. Bartlett; J. D. Pannone; H. W. Arnold

[57] ABSTRACT

A microwave oven control system in which the average microwave power may be selected by selecting different duty cycles of a cyclically closing semiconductor switch controlling the AC power supplied to a microwave magnetron anode power supply which has a saturable high voltage transformer with input current surges to said power supply being minimized by turning on said switch in the region a voltage peak of said AC power and with the cycle time of said switch being greater than the AC power cycle time but being substantially less than the thermal response time of a food body being cooked by microwave energy so that changing the duty cycle can change the power applied to the food body rapidly in the event that undesired results such as boiling over or burning of the food body are observed.

10 Claims, 3 Drawing Figures

VARIABLE POWER CONTROL MICROWAVE OVEN

CROSS REFERENCE TO COPENDING APPLICATIONS

Copending application Ser. No. 671,527 filed Mar. 29, 1976 now abandoned, by Rex E. Fritts and assigned to the same assignee as this application is hereby incorporated by reference and its disclosure is made a part of this application.

BACKGROUND OF THE INVENTION

Attempts to successfully market microwave ovens having timers to cyclically turn on and off microwave power to the oven with cycle times on the order of a second have had poor results since such ovens have had high input surge currents. Such high current surges occurred much more often during such one second cycles in the cooking program and could blow fuses more often than in the conventional cycling cooking programs having, for example, one minute cooking cycles with a motor driven mechanically actuated switch used for defrost programs.

SUMMARY OF THE INVENTION

This invention discloses the discovery that defrosting and cooking programs for foods may have on-off cycles having periodicity substantially less than the heat response time of the food body without random occurrences of high input surge currents from the AC power source.

More specifically, in accordance with this invention, a cycle time on the order of 1-10 seconds has been found to permit control of the oven with power levels from 10 percent to full power with a reduced input current surge by having the AC power turned on during a first phase of said power and turned off during a second phase of said power to achieve defrosting, simmering, and cooking.

In addition, this invention discloses that such a system can be adjustably programmed to start and stop each cycle of the desired microwave heating program by a semiconductor timer whose program can be changed to change the power level of the heating program while the heating program is in progress.

BRIEF DESCRIPTION OF THE DRAWINGS

Other and further objects and advantages of this invention will be apparent as the description thereof progresses, references being had to the accompanying drawings wherein.

DESCRIPTION OF THE PREFERRED EMBODIMENT

Figure 1:
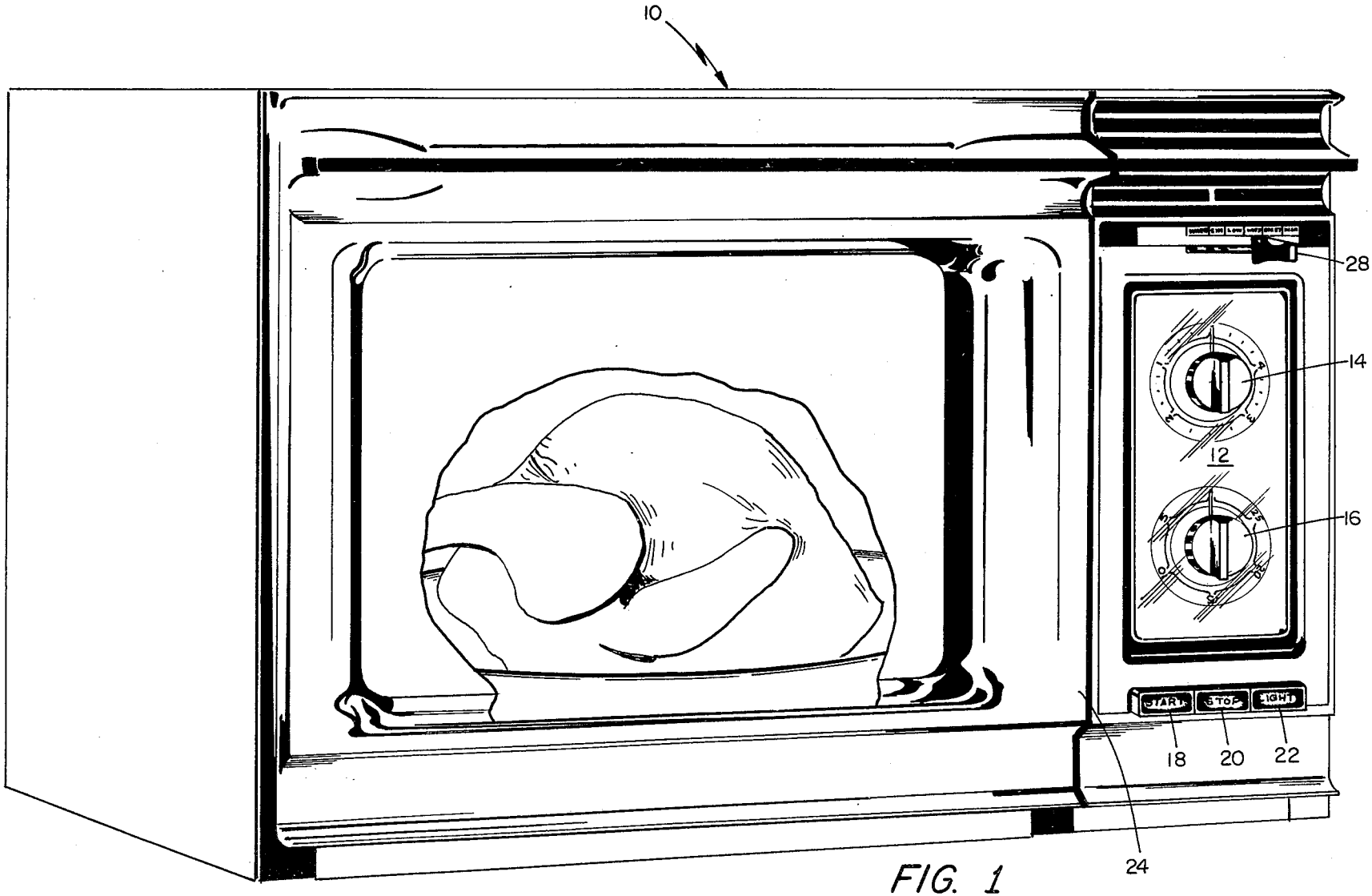
FIG. 1 illustrates a microwave oven embodying the invention.
Figure 2:
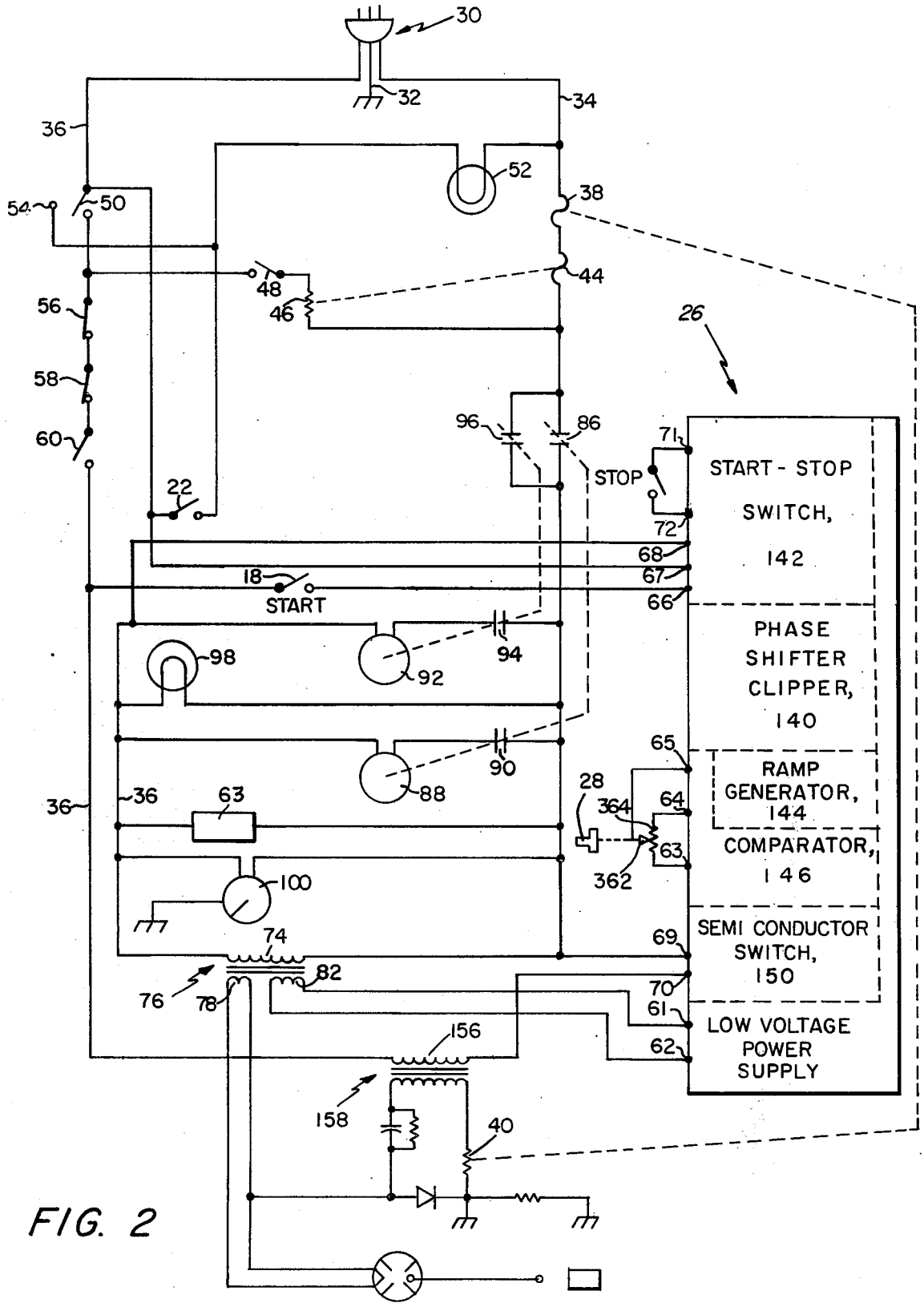
FIG. 2 illustrates circuit details of an illustrative example of the functional flow schematers of FIG. 1.
Figure 3:
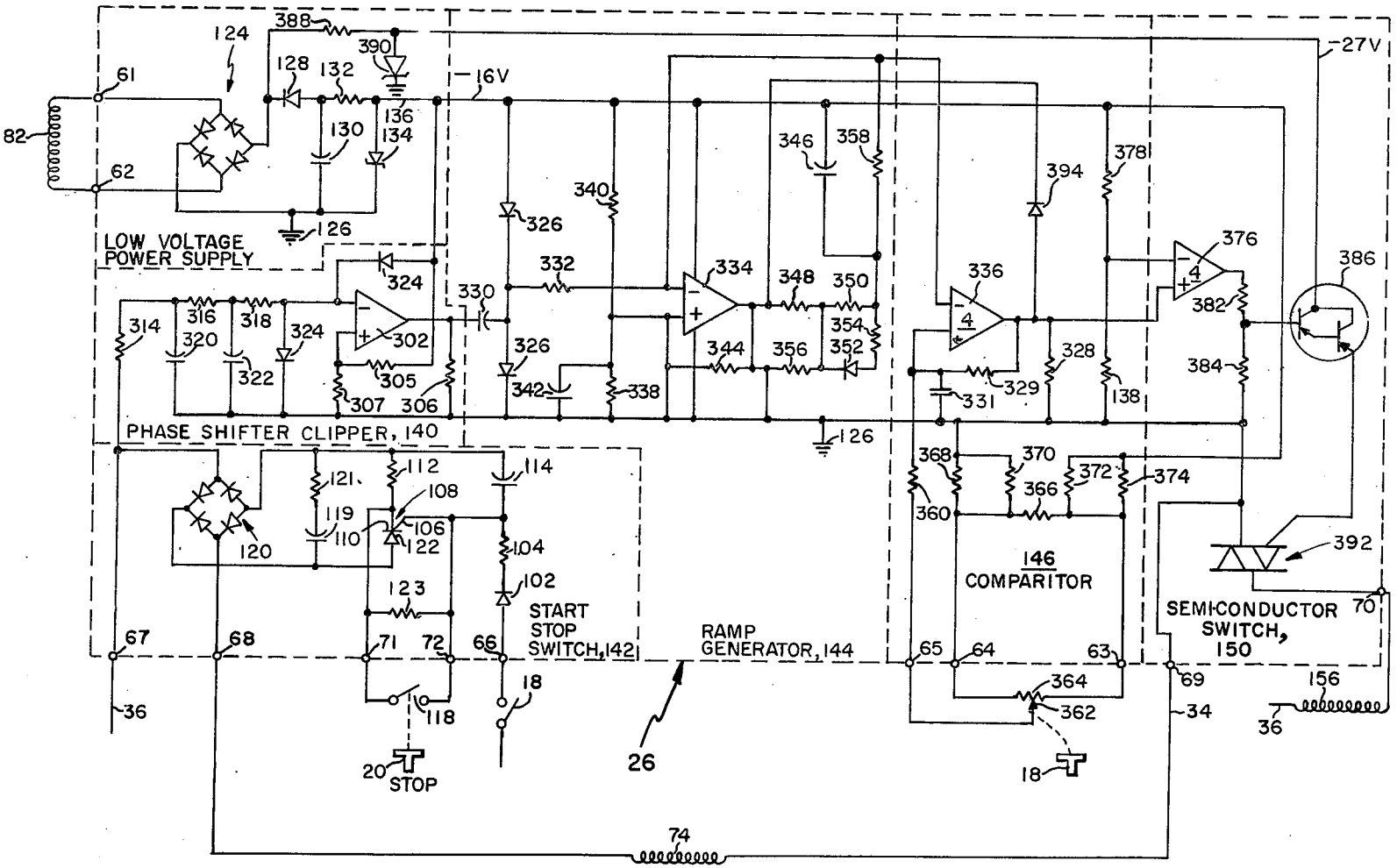
FIG. 3 illustrates a timing diagram for operation of the system of FIGS. 1 and 2.

Referring now to FIGS. 1-3, there is shown a microwave oven 10 having a front panel control 12 comprising a five-minute timer set by a control knob 14, a thirty-minute timer set by a control knob 16, a push button start switch 18, a push button stop switch 20, a manually actuated light switch button 22 for a light inside the oven, and a variable power slide control 28.

The oven has a door 24 which actuates mechanical interlock switches, for example, as shown in my U.S. Pat. No. 3,766,437. The oven is fed with microwave energy and air is circulated therethrough in accordance with the practice shown in the aforesaid patent.

In FIG. 2 there is shown the example of a power control diagram for the oven of FIG. 1 embodying the invention. Power is supplied from a conventional plug 30 having a grounded prong 32 which may be plugged into 110 volt 60 cycle plug in a home. One side of the plug is connected to power bus 34 and the other side of the plug is connected to power bus 36. Power bus 34 is connected through fuse elements 38 and 44 and mechanically actuated timing contacts 86 or 96 to one end of transformer winding 74.

Fuse 38 is heated by a resistor 40 in the space current path of a microwave magnetron 42 supplying microwave energy to the oven 10 so that if excess current is drawn by the magnetron 42, it will blow the fuse 38. Fuse 44 is an interlock fuse element which is heated by a resistor 46 connected between bus 34 after passing from plug 30 through elements 44 and 38 and bus 36 through an interlock switch 48 which is mechanically actuated by the door 24 and is normally closed when door 24 is open and an interlock switch 50 actuated by door 24 and normally open when door 24 is open.

An oven light 52 is connected between the buses 34 and 36 through a contact 54 of switch 50 which is closed when door 24 is open to light the light 52. Push button switch 22 is connected in parallel with switch contact 54 and switch 50 to permit the light 52 to be turned on and off manually when door 24 is closed.

Bus 36 is connected from switch 50 through a thermally actuated switch 56 which senses the temperature of magnetron 42 and a cavity, thermally actuated switch 58 which senses the temperature of the walls of the oven, and latch sensing switch 60 and through start switch 18 to an input terminal 66 of a control module 26.

When door 24 is closed and momentary contact start switch 18 is pushed, bus 36 is connected through terminals 67 and 68 of control module 26 to the opposite side of winding 74 from that of bus 34. Winding 74 is the primary winding of transformer 76 which has a filament winding 78, connected to the filament 80 of magnetron 42, and a control power winding 84 connected across terminals 61 and 62 of module 26 to supply control power thereto. Either of normally open contacts of switches 86 and 96 are mechanically closed by setting knobs 16 or 14 respective to times for cooking. Timer motor 88 and switch 90, which is mechanically coupled to switch 86, are connected in series across winding 74 so that when knob 16 is turned to set a time up to thirty minutes as indicated by the pointer on knob 16, timer motor 88 will run driving knob 16 to zero time where contacts of switches 90 and 86 open deenergizing to transformer 76 and motor 88. A five-minute timing motor 92, which operates a switch 94 in series with motor 92 across transformer winding 74 and mechanically coupled to switch 96, is used to set times up to five minutes by knob 14 for more accurate timing of short cooking intervals.

A latch locking solenoid 63 and blower motor 100 are also connected across winding 74 so that these are actuated to lock door 24 closed and drive a blower, not shown, to blow cooled air past magnetron 42 whenever power is supplied to the transformer 76. Air from the blower is preferably also directed into the oven through apertures in the back wall to rotate a mode stirrer for causing variation in the resonant mode patterns of microwave energy supplied to the oven. Details of such magnetrons and air circulation are described in greater detail in my aforementioned copending application.

Module 26 has low voltage DC power supply fed from a filament transformer winding 82 through terminals 61 and 62. Power supplied by start switch 18 to terminal 66 of module 26 connects bus 36 through terminal 67 to terminal 68 energizing one terminal of the primary winding 74 of filament transformer 76.

Terminal 67 of module 26 also feeds the input 60 hertz sine wave of bus 36 to a phase shifter clipper which delays the sine wave by 90° and clips and differentiates it to produce alternately positive and negative spikes at the zero voltage crossover points which trigger a ramp generator on and off on a .75 second cycle and trigger a comparator fed by a reference voltage from a potentiometer connected to terminals 63, 64, and 65 of module 26, and adjusted by control 28 so that the comparator and generator form a pulse turning on and off a semiconductor switch connecting bus 34 to the opposite terminal of the winding 156 from that connected to bus 36. Winding 156 is thus energized at a peak of the sine wave of the 60 hertz input power and deenergized several hertz later, dependent on the setting of control 28, during the opposite phase of the 60 hertz input power to set the flux in transformer 158, which is of the saturable regulating type shown, for example, in U.S. Pat. No. 3,396,342, in the opposite direction from that produced initially by the next energization of the transformer. Circuit details for module 26 are shown in FIG. 3 by way of example only and any desired circuitry to provide the functions described may be used.

As illustrated herein, terminal 66 is connected through diode 102 and current limiting resistor 104 to the control electrode 106 of SCR 108 whose cathode 110 is connected through a resistor 112 and an electrolitic condenser 114 to control electrode 106. Cathode 110 is also connected to terminal 71 of module 26 which is connected to the terminal 72 of control module 26 through normally open switch 118 actuated by stop button 20. A bridge rectifier 120 has its common cathode terminal connected to the anode 122 of the SCR 108 and its common anode terminal connected to the junction between resistor 112 and condenser 114. The remaining two terminals of bridge rectifier 120 are connected to terminals 67 and 68 so that when start switch 18 is momentarily closed SCR 108 conducts permitting unidirectional current to flow between the common anode and common cathode terminals of bridge rectifier 120, and effectively connects terminals 67 and 68 together thereby energizing control transformer 76 whose winding 82 is connected to terminals 61 and 62 of module 26 to supply an alternating voltage of, for example, 24 volts RMS to a bridge rectifier 124 whose positive output is grounded at 126 and whose negative output is supplied through a diode 128 to a filter capacitor 130 across which is connected a voltage dropping resistor 132 and a zener diode 134. An output bus 136, connected to the junction of resistor 132 and zener diode 134, has a DC voltage of, for example, −26 volts.

Terminal 67 is also connected through a phase shifter clipper circuit 140 to a ramp generator circuit 144 which supplies a cyclical negative going saw tooth waveform having a periodicity in the range of 0.5 to 1 second to comparator circuit 146 which compares the voltage with the voltage supplied from the movable contact arm 362 of a potentiometer 364 mechanically actuated by slide arm 28.

The output of comparator circuit 146 is a negative-going pulse having the same periodicity as the saw tooth of ramp generator 144 and drives semiconductor switch 150 which supplies power from bus 34 to the primary winding 156 of high voltage regulating transformer 158.

Module 26 uses a quad amplifier integrated circuit such as RCA part 339. Phase shifter clipper circuit 140 comprises a phase shifting network consisting of resistors 314, 316, and 318 and condensers 320 and 322 to the negative input of the amplifier 302 and to the diodes 324 connected back biased in series between input bus 136 and ground with their junction connected to said negative input. This applies a clipped sine wave from the 110 volts 60 hertz supply, phase shifted by 90°, and having a 16 volts peak-to-peak square wave shape to said negative input of amplifier 302. The amplifier 302 is of differential type with the phase inverting input to output section labelled "−", and the in-phase input is labelled "+", and is connected to the junction of resistors 310 and 312 connected in series between bus 136 and ground. The output of the amplifier appears across resistor 306 as positive and negative spikes occurring as the peaks of the waveform produced by coupling the output through condenser 330 to the junction of diodes 326 connected back biased in series between the bus 136 and ground. Such a phase shifter clipper is described by way of example only and any phase shifter clipper may be used.

The output of condenser 330 is connected through an isolating resistor 332 to the negative input of a second amplifier stage 334, which is a part of a saw tooth or ramp generator having a time base of, for example, 0.75 of a second and is also connected directly to the negative input of an amplifier 336 which acts as a comparator. The positive input of amplifier 334 is connected to the junction of a voltage divider network comprising resistors 338 and 340 connected between the negative power supply and ground. A condenser 342 is also connected between positive input amplifier 334 and ground in parallel to the resistor 338. The output of amplifier 334 is connected back to the positive input through a resistor 344 to a condenser 346 through resistors 348 and 350 in series and to the output of amplifier 336 through a diode 394, which is poled to conduct when the output of 334 is driven more negative than the output of 336. A diode 352 is connected in parallel with resistor 350 through resistor 354 and is poled to conduct when the output of amplifier 334 goes more negative than the potential at the junction of condenser 346 and resistor 350, said potential being fed to the negative inputs of amplifiers 334 and 336 through resistor 358. A resistor 356 is connected from common junction of diode 352 and resistor 350 to ground.

In operation, the output of amplifier 334 moves positive whenever its negative input goes more negative than its positive input thereby causing condenser 346 to charge positively toward ground by conduction through resistors 350 and 356 such positive excursions being fed back through resistor 344 so that condenser 346 must charge a substantial amount toward ground prior to negative input of amplifier 334 becoming more positive than the positive input due to the voltage on the condenser 346 being fed back through resistor 358 to said negative input whereupon the output of amplifier 334 moves negative discharging condenser 346 through resistor 356, diode 352, and resistor 354 until said negative input of 334 is negative with respect to its positive input.

The negative spikes supplied through resistor 332 cause the output of amplifier 334 to switch positive, or move up, at points in phase with the leading edges of said spikes.

The input to amplifier 336 supplied from the negative input of amplifier 334 is also the negative input of amplifier 336 and the positive input of amplifier 336 is connected through current limiting resistor 360 to the tap 362 of a potentiometer 364, which is connected in parallel with resistor 366 at one end ground through resistors 368 and 370 in parallel, and the other end connected to negative supply bus 136 through resistors 372 and 374, in parallel. The negative voltage supplied to the positive input of amplifier 336 is adjusted by varying the tap 362 so that the saw tooth waveform voltage supplied to the negative input of amplifier 336 will go more positive than the voltage supplied to the positive input of amplifier 336 at a time in the saw tooth cycle which is dependent on the setting of tap 362 and is coincident with a positive spike leading edge of the waveform derived from phase shifter clipper 140 through resistor 332. At such crossover time, the output of amplifier 336 moves negative and stays negative due to diode 394 until amplifier 334 output moves negative to charge condenser 346 and then moves positive. The positive moving voltage output of amplifier 334 is as previously stated, coincident with a negative going leading edge of the output of resistor 332, so that the negative pulse output of 336 starts and stops at opposite phase peaks of the power input on bus 36

The output of 336 is connected to the positive input of amplifier 376, whose negative input is connected to the junction of resistors 378 and 380 connected between the negative supply and ground and the output of 336 is connected to ground through load resistor 328.

The output of amplifier 376 is developed across load resistors 382 and 384 connected in series to ground. The junction of 382 and 384 is connected to the base of a darlington output amplifier 386 whose collector is supplied with power of −27 volts directly from negative power supply bridge rectifier circuit 124 through a dropping resistor 388, said voltage being held constant by a zener diode 390. The output of 386 drives the control electrode of a thyristor 392 to connect power to the high voltage transformer primary winding 156.

The value of resistors and condensers for the circuit of FIG. 3 may be as follows:

| Part Number | Resistor in Ohms |
|---|---|
| 104 | 68K |
| 112 | .22 |
| 121 | 10 |
| 123 | 2K |
| 132 | 430 |
| 305 | 120K |
| 306 | 10 |
| 307 | 27K |
| 314 | 27K |
| 316 | 27K |
| 318 | 1,000K |
| 328 | 15K |
| 329 | 6.8K |
| 332 | 82K |
| 338 | 82K |
| 340 | 100K |
| 344 | 30K |
| 348 | 3.9K |
| 350 | 1,200K |

-continued

| | |
|---|---|
| 354 | 56K |
| 356 | 15K |
| 358 | 18K |
| 360 | 3K |
| 364 | 10K |
| 366 | 2.2K |
| 368 | 1.1K |
| 370 | 10K |
| 372 | 10K |
| 374 | 2K |
| 378 | 15K |
| 380 | 47K |
| 382 | 10K |
| 384 | 27K |
| 388 | 200 |

| Part Number | Condenser in Microfarads |
|---|---|
| 119 | .1 |
| 130 | 22.0 |
| 320 | .1 |
| 322 | .1 |
| 330 | .002 |
| 331 | .01 |
| 342 | .01 |
| 346 | .47 |

This completes the description of the embodiment of the invention disclosed herein. However, many modifications thereof will be apparent to persons skilled in the art. For example, different circuits can be used for module 26 and different interlock systems can be used. Accordingly, it is intended that this invention be not limited except as defined by the appended claims.

What is claimed is:

1. A microwave oven comprising:

a cavity having an access aperture and a closure member;

a source of microwave energy comprising a magnetron coupled to said cavity;

a power supply for said magnetron comprising a transformer;

semiconductor switch means for cyclically connecting said transformer at a first cycle rate greater than 1 in 10 seconds to a source of AC power having a second cycle rate higher than said first cycle rate; and means for turning said switch on at a predetermined phase angle of one polarity of said AC power and turning said switch off at a predetermined phase angle of the opposite polarity of said AC power.

2. The microwave oven in accordance with claim 1 wherein:

said transformer feeds a voltage doubler supplying said magnetron.

3. The microwave oven in accordance with claim 1 wherein:

said transformer has an output power regulating characteristic.

4. The microwave oven in accordance with claim 1 wherein:

said switch is a thyristor.

5. The microwave oven in accordance with claim 1 wherein:

said semiconductor switch means has an on-off duty cycle which is changed by manual control means.

6. A microwave oven comprising:

a cavity having an access aperture and a closure member;

a source of microwave energy comprising a magnetron coupled to said cavity;

a power supply for said magnetron comprising a transformer;

semiconductor switch means for cyclically connecting said transformer in a first cycle having a periodicity between 5. and 1 second to a source of AC power having a second cycle whose periodicity is at least an order of magnitude less than said first cycle periodicity; and means for turning said switch on and off respectively at different predetermined phases during respectively opposite polarities of said AC power.

7. The microwave oven in accordance with claim wherein:

said transformer feeds a voltage doubler supplying said magnetron.

8. The microwave oven in accordance with claim 6 wherein:

said transformer has an output power regulating characteristic.

9. The microwave oven in accordance with claim 6 wherein:

said switch is a thyristor.

10. The microwave oven in accordance with claim 6 wherein:

said semiconductor switch means has an on-off duty cycle which is changed by manual control means.

* * * * *